US007377757B2

(12) United States Patent
Walch, Jr. et al.

(10) Patent No.: US 7,377,757 B2
(45) Date of Patent: May 27, 2008

(54) FLUID PUMP WITH ENHANCED SEAL

(75) Inventors: Michael D. Walch, Jr., Port Orchard, WA (US); James A. Wiegand, Auburn, WA (US)

(73) Assignee: Graves Spray Supply, Inc., Clearwater, FL (US)

( * ) Notice: Subject to any disclaimer, the term of this patent is extended or adjusted under 35 U.S.C. 154(b) by 496 days.

(21) Appl. No.: 11/232,554

(22) Filed: Sep. 22, 2005

(65) Prior Publication Data

US 2007/0065320 A1 Mar. 22, 2007

(51) Int. Cl.
*F04B 53/12* (2006.01)
*F01B 31/00* (2006.01)

(52) U.S. Cl. ..... 417/554; 417/547; 92/86

(58) Field of Classification Search ..... 417/554; 277/434, 510, 516, 616; 92/86
See application file for complete search history.

(56) References Cited

U.S. PATENT DOCUMENTS 2,570,647 A 10/1951 Cormier
3,056,353 A 10/1962 Peters
3,777,623 A * 12/1973 Bosch ..... 91/487
3,966,360 A 6/1976 Greene
4,197,707 A * 4/1980 Asano ..... 60/517
4,206,928 A * 6/1980 Asano ..... 277/317
5,031,509 A 7/1991 Cowan
5,094,596 A * 3/1992 Erwin et al. ..... 417/397
5,354,185 A * 10/1994 Morinigo et al. ..... 417/410.1
5,363,666 A * 11/1994 Tieken ..... 62/129
5,415,531 A * 5/1995 Cavanaugh ..... 417/397
6,648,603 B2 * 11/2003 Dexter et al. ..... 417/34
6,659,734 B1 12/2003 Hervault
2005/0074350 A1 4/2005 Raghaven et al.
2005/0084389 A1 4/2005 Boos et al.
2005/0098956 A1 5/2005 McCutchan

* cited by examiner

*Primary Examiner*—Ninh Nguyen
*Assistant Examiner*—Amene S Bayou
(74) *Attorney, Agent, or Firm*—Larson & Larson; Frank Liebenon

(57) ABSTRACT

The invention concerns a fluid pump with a cylinder, piston and check valve for compressing the fluid having a high-pressure seal for precluding leakage of pressurized fluid. Any leakage from the high-pressure seal feeds back into an inlet area of the pump and recycles through the pump instead of leaking externally.

21 Claims, 4 Drawing Sheets

FLUID PUMP WITH ENHANCED SEAL

BACKGROUND OF THE INVENTION

1. Field of the Invention

This invention relates to the field of pumps and more particularly to a pump with an enhanced high-pressure seal.

2. Description of the Related Art

High pressure pumps are used in many applications including hydraulic systems, pressure washers and presses. A high-pressure pump is described in U.S. Pat. No. 6,092,370 to Tremoulet, Jr. et al., issued on Jul. 25, 2000 and is hereby incorporated by reference in its entirety.

Often, high pressure pumps are used in applications where leaks are a problem. For example, a leaking pump in an airplane may cause the loss of hydraulic fluid. Furthermore, the lost fluid may create an environmental issue or, at least, may create a stain or a slippery area that may contribute to falling or slipping danger.

One problem area in high pressure pumps is the high pressure seal which helps keep pressurize fluids inside the pump. At high pressures, some exceeding 100,000 psi, high pressure seals often fail. It is believed that leaking of the high pressure seal may be the most common problems in high pressure pumps. The failure usually begins with a slow leak, wherein the pump is fully functional and only a small amount of fluid is lost. Furthermore, beyond a slight loss in output pressure, leaks from the high pressure seal can also impact other parts of the pump through loss of lubrication, fatigue and corrosion.

This problem is known in the industry and has been addressed by many solutions including placing a higher, more even force on the seal. For example, US Publication 2005/0074350A1 to Raghavan, et al., published Apr. 7, 2005, describes a "Device and Method for Maintaining a Static Seal of a High Pressure Pump," and is hereby incorporated by reference. A pump is described in U.S. Pat. No. 3,966,360 to Greene, issued Jun. 29, 1976. This pump has an outer casing forming a reservoir. Such solutions may improve the performance of such seals, but they do not prevent the problem and, when a seal leaks, the loss of fluid or the resulting spill may cause problems.

What is needed is a pump with a high pressure seal in which any leaking in the high pressure seal feed back into the input chamber of the pump.

SUMMARY OF THE INVENTION

In one embodiment, a pump is disclosed including a cylinder in which a fluid is compressed, an inlet for accepting a fluid into the pump, an inlet area connected to the inlet for transporting the fluid across the pump and a feed tube for transporting the fluid from the inlet area to the cylinder. A check valve is provided to allow the fluid to flow from the feed tube and into the cylinder while blocking the flow of the fluid from the cylinder back into the feed tube. A piston is configured within the cylinder for compressing the fluid and a piston rod is coupled to the piston for exerting force on the piston. The piston is held within the cylinder by a high pressure seal. A high-pressure output port is connected to the cylinder for outputting the fluid under pressure. The high pressure seal interfaces with the inlet area so that any leakage of the fluid through the high pressure seal leaks back into the inlet area.

In another embodiment, a method of reducing leakage in a pump is disclosed including providing a fluid into an inlet of a pump, the fluid flowing through an inlet area and flowing through a feed tube and flowing through a check valve and into a cylinder; then applying force to the piston within the cylinder to pressurize the fluid. The check valve prevents the fluid from leaving the cylinder back into the feed tube. The piston and cylinder are sealed using a high pressure seal and potential leakage is captured from the high pressure seal by interfacing the high pressure seal with the inlet area.

In another embodiment, a pump is disclosed including a cylinder having a bore in which a fluid may be compressed with an inlet for accepting the fluid into the pump and an inlet area connected to the inlet for conducting fluid across the pump. A feed tube for transports the fluid from the inlet area to a first end of the cylinder and a check valve allows the fluid to flow in one direction into the first end of the cylinder from the feed tube. A piston within the cylinder compresses the fluid whereby a piston rod coupled to the piston exerts force on the piston. A high pressure seal is provided for retaining the piston within the cylinder while retarding the fluid from leaking from the cylinder under pressure and a high-pressure output port is connected to a second end of the cylinder for outputting the fluid under pressure. The high pressure seal interfaces with the inlet area such that any leakage of the fluid through the high pressure seal feeds back into the inlet area.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
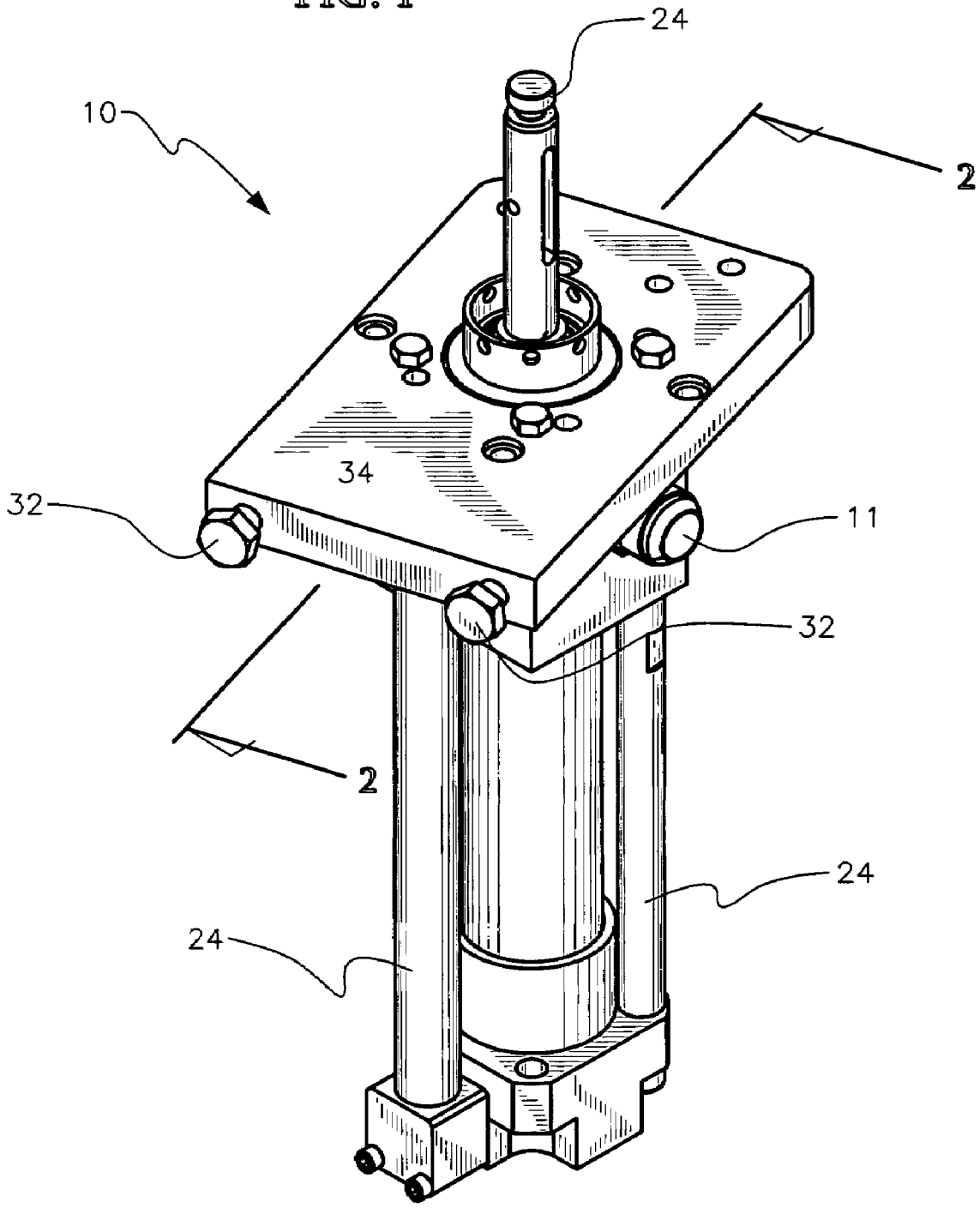
FIG. 1 illustrates a pictorial view of a pump of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a pictorial view of a pump present invention is shown. Shown is the pump 10 with inlet 11 providing a source of fluids to the pump. A mounting plate 34 is provided with mounting bolts 32. Tie rods 24 are provided to maintain pressure on the seals. A piston rod adapter 24 provides reciprocating motion to a piston within the pump 10, pressurizing the fluid.

Figure 2:
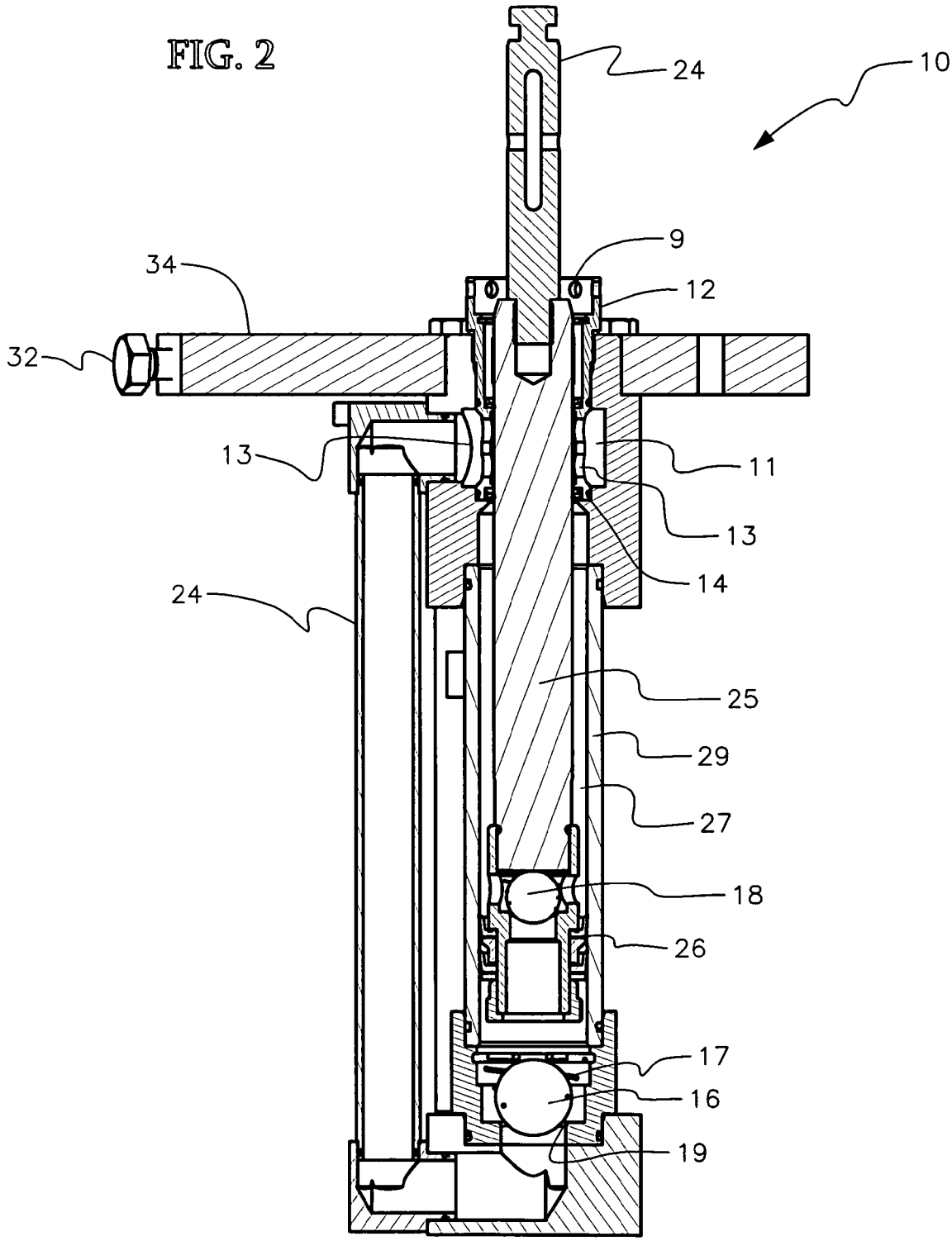
FIG. 2 shows a cross section along line 2-2 of FIG. 1.

Referring now to FIG. 2, the components of the pump 10 will be described. A mounting plate 34 has mounting bolts 32 for mounting the pump 10 to other equipment. A piston rod 25 couples the piston rod adapter 24 to the piston 26 so that reciprocating motion applied to the piston rod adapter 24 causes the piston 26 to move in and out of the cylinder 27 formed by cylinder walls 29. An inlet 11 is provided for allowing fluid to enter the pump 10 through the inlet area 13, where it flows through to a feed tube 24 and enters the cylinder 27 through a first check valve 16 which restricts the direction of flow of the fluid in a direction into the cylinder. In some embodiments, the check valve 16 is a ball 16 made of a hard material such as steel. In some embodiments, the ball 16 prevents a reverse flow of fluids by seating against a seat 19 when reverse pressure is applied. In some embodiments, gravity or fluid pressure seats the ball 16. In some embodiments, a spring 17 maintains pressure on the ball 16 to reduce back pressure.

In some embodiments, a second check valve 18 is adapted within the piston 26, restricting the direction of flow of fluid, allowing flow from within the cylinder 27 below the piston 26 into the cylinder 27 above the piston 26. A high pressure seal 14 helps prevent fluid under a high pressure from leaking while a low-pressure seal 12 helps prevent low pressure fluid from leaking. A guide bushing 9 keeps the low pressure seal 12 in place. To prevent external leakage of fluid, the high pressure seal 14 is interfaced and enclosed by the fluid inlet area 13 such that leakage through the high pressure seal 14 will seep into the fluid inlet area 13 and re-circulate through the pump 10 instead of exiting the pump 10.

Figure 3:
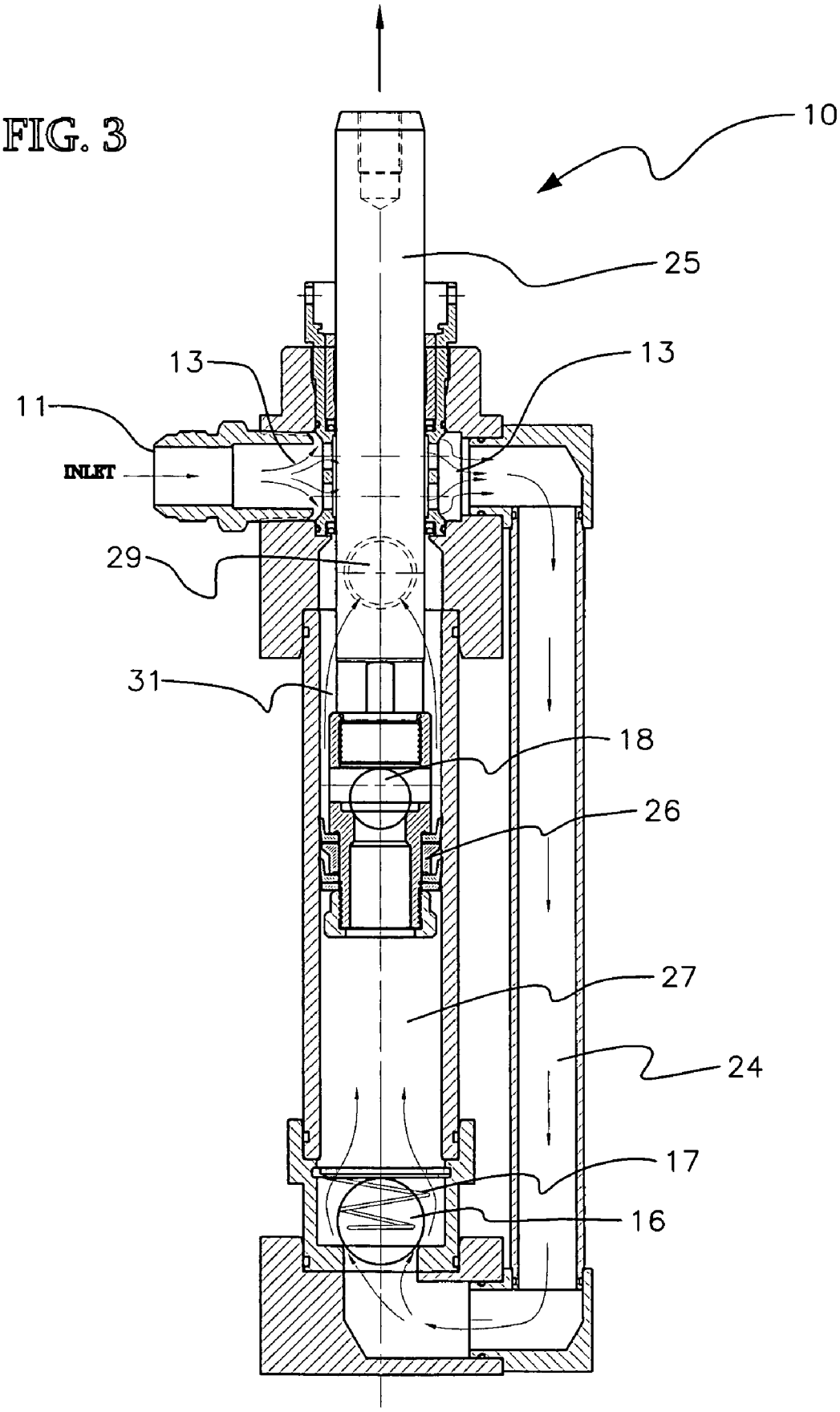
FIG. 3 shows a cross section along line 2-2 of FIG. 1.
Figure 4:
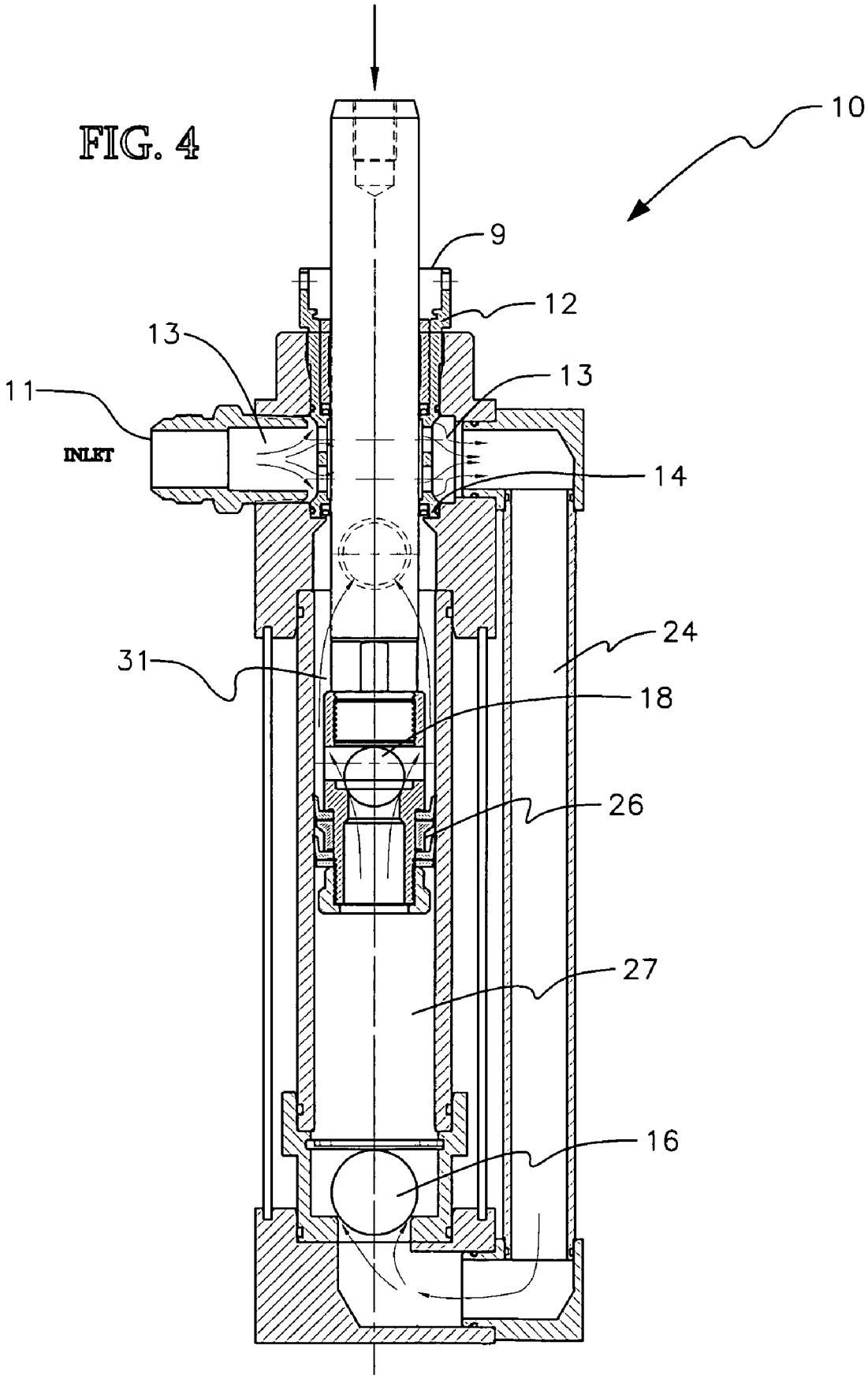
FIG. 4 shows a cross section along line 2-2 of FIG. 1.

Referring now to FIGS. 3 and 4, the operation of the pump will be described. FIG. 3 describes the operation of the pump during an up stroke of the piston rod 25. During this, as the piston 26 moves up within the cylinder 27, the space vacated by the piston 26 is replaced by fluid entering through the check valve 16 from the feed tube 24, which receives fluid through an inlet 11, passing through inlet area 13. During this movement, fluid from a previous stroke 31 in the cylinder above the piston 26 is prevented from flowing back below the piston 26 by a second check valve 18, thereby forcing the fluid under high pressure to exit the outlet 29. FIG. 4 describes the operation of the pump during a down stroke of the piston rod 25. During this, the piston 26 moves down within the cylinder 27, placing a pressure on the fluid already within the cylinder 27. The check valve 16 prevents the fluid from exiting through the feed tube 24. Being that the volume of the lower part of the cylinder 27 is greater than the volume of the cylinder above 31 the piston 26, the fluid is forced through the second check valve 18 and into the upper portion of the cylinder and out the outlet 29 under pressure.

Being that the fluid is under a very high pressure, a high pressure seal 14 helps prevent the high pressure liquid from leaking out of the pump. A low pressure seal 12 is provided to help keep low pressure fluids from leaking out of the pump 10. A guide bushing 9 keeps the low pressure seal 12 in place. Being that the high pressure seal interfaces with the fluid inlet area 13, any fluid leaking through the high pressure seal 14 will re-circulate through the inlet area 13 and mix with low pressure fluid, flowing back through the feed tube 24 into the pump 10 instead of exiting the pump.

Equivalent elements can be substituted for the ones set forth above such that they perform in substantially the same manner in substantially the same way for achieving substantially the same result. Although the above description describes a double acting pump, in that a symmetrical pressure is created on both the up stroke and the down stroke, the same high-pressure seal and fluid inlet area interface can be equally applied to a single action pump without veering from the present invention.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A pump comprising:

a cylinder in which a fluid is compressed;

an inlet for accepting the fluid into the pump;

an inlet area connected to the inlet for transporting the fluid across the pump;

a feed tube for transporting the fluid from the inlet area into the cylinder;

a check valve for allowing the fluid to flow from the feed tube into the cylinder, the check valve blocking the flow of the fluid from the cylinder back into the feed tube;

a piston configured within the cylinder for compressing the fluid;

a piston rod coupled to the piston for exerting force on the piston, the piston being held within the cylinder by a high pressure seal; and a high-pressure output port connected to the cylinder for outputting the fluid under pressure;

whereas the high pressure seal interfaces with the inlet area such that any leakage of the fluid through the high pressure seal leaks back into the inlet area.

2. The pump of claim 1, wherein the check valve is a ball and a seat.

3. The pump of claim 2, wherein the ball is biased against the seat by a spring.

4. The pump of claim 1, further comprising a second check valve adapted to the piston, the second check valve providing for compressing the fluid on both an up stroke and a down stroke of the piston.

5. The pump of claim 4, wherein the second check valve is a second ball and a second seat.

6. The pump of claim 5, wherein the second ball is biased against the second seat by a second spring.

7. The pump of claim 1, further comprising a low pressure seal, the low pressure seal held in place with a guide bushing, the low pressure seal retaining the fluid within the inlet area.

8. A method for reducing leakage in a pump, the method comprising:

providing a fluid into an inlet of a pump, the fluid flowing through an inlet area and flowing through a feed tube and flowing through a check valve and into a cylinder;

applying force to a piston within the cylinder to pressurize the fluid, the check valve preventing the fluid from leaving the cylinder back into the feed tube;

sealing the piston and cylinder using a high pressure seal; and interfacing the high pressure seal with the inlet area wherein a leak of the fluid from the high pressure seal enters the inlet area and re-circulates through the pump.

9. The method for reducing leakage in a pump of claim 8, wherein the check valve is a ball and a seat.

10. The method for reducing leakage in a pump of claim 9, wherein the ball is biased against the seat by a spring.

11. The method for reducing leakage in a pump of claim 9, further comprising a second check valve adapted to the piston, the second check valve providing for compressing the fluid on both an up stroke and a down stroke of the piston.

12. The method for reducing leakage in a pump of claim 11, wherein the second check valve is a second ball and a second seat.

13. The method for reducing leakage in a pump of claim 12, wherein the second ball is biased against the second seat by a second spring.

14. The method for reducing leakage in a pump of claim 8, further comprising a low pressure seal, the low pressure seal held in place with a guide bushing, the low pressure seal retaining the fluid within the inlet area.

15. A pump comprising:

a cylinder having a bore in which a fluid may be compressed;

an inlet for accepting the fluid into the pump;

an inlet area connected to the inlet for conducting the fluid across the pump;

a feed tube for transporting the fluid from the inlet area to a first end of the cylinder;

a check valve for allowing the fluid to flow in one direction into the first end of the cylinder from the feed tube;

a piston configured within the cylinder for compressing the fluid;

a piston rod coupled to the piston for exerting force on the piston;

a high pressure seal for retaining the piston within the cylinder and for retarding the fluid from leaking from the cylinder when the fluid is under pressure; and a high-pressure output port connected to a second end of the cylinder for outputting the fluid under pressure;

whereas the high pressure seal interfaces with the inlet area such that any leakage of the fluid through the high pressure seal feeds back into the inlet area.

16. The pump of claim 15, wherein the check valve is a ball and a seat.

17. The pump of claim 16, wherein the ball is biased against the seat by a spring.

18. The pump of claim 16, further comprising a second check valve adapted to the piston, the second check valve providing for compressing the fluid on both an up stroke and a down stroke of the piston.

19. The pump of claim 18, wherein the second check valve is a second ball and a second seat.

20. The pump of claim 19, wherein the second ball is biased against the second seat by a second spring.

21. The pump of claim 14, further comprising a low pressure seal, the low pressure seal held in place with a guide bushing, the low pressure seal retaining the fluid within the inlet area.

* * * * *